US006913012B2

(12) United States Patent
Divett et al.

(10) Patent No.: US 6,913,012 B2
(45) Date of Patent: Jul. 5, 2005

(54) COOKING APPLIANCE VENTING SYSTEM

(75) Inventors: Timothy Andrew Divett, Dunedin (NZ); Deborah Eden Byrom, Auckland (NZ); Karen Marie O'Neill, Otago (NZ); Dennis Mervyn Wai, Dunedin (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 0 days.

(21) Appl. No.: 10/402,634

(22) Filed: Mar. 28, 2003

(65) Prior Publication Data

US 2004/0079355 A1 Apr. 29, 2004

(30) Foreign Application Priority Data

Oct. 25, 2002 (NZ) ..... 522298
Oct. 30, 2002 (NZ) ..... 522313

(51) Int. Cl.[7] ..... F24C 15/20
(52) U.S. Cl. ..... 126/21 A; 126/273 R; 219/400
(58) Field of Search ..... 126/21 A, 21 R, 126/273 R; 422/169, 217; 219/400

(56) References Cited

U.S. PATENT DOCUMENTS 3,480,000 A * 11/1969 Torrey et al. ..... 126/21 A
4,547,642 A 10/1985 Smith
4,592,333 A * 6/1986 Dustin ..... 126/21 R
4,654,508 A 3/1987 Logel et al.
5,556,819 A * 9/1996 Bar-Ilan ..... 502/22
5,738,081 A * 4/1998 Puricelli ..... 126/21 A
2001/0052515 A1 12/2001 Allera et al.
2002/0059930 A1 * 5/2002 Schmidmayer et al. ... 126/21 R
2002/0162833 A1 * 11/2002 Arntz et al. ..... 219/400

FOREIGN PATENT DOCUMENTS

CH 631802 8/1982
DE 19912453 A1 * 9/2000 ..... F24C/14/00
GB 2256921 A * 12/1992 ..... F24C/15/32
GB 2325299 11/1998
JP 4-203811 A * 4/1992 ..... F24C/15/20
WO WO9900176 1/1999

* cited by examiner

*Primary Examiner*—Sara Clarke
(74) *Attorney, Agent, or Firm*—Trexler, Bushnell, Giangiorgi, Blackstone & Marr, Ltd.

(57) ABSTRACT

A domestic cooking appliance that includes a cabinet, and at least one oven. Air space is provided between the cabinet and the oven. The cooking appliance includes venting to allow air to enter and exit the air space and an exhaust passage connecting the oven with the air space. Means to clean air and a fan are located in the exhaust passage. A controller controls the operation of the appliance including activation of the fan and air cleaning means during operational modes of the appliance.

8 Claims, 6 Drawing Sheets

COOKING APPLIANCE VENTING SYSTEM

BACKGROUND OF INVENTION

1. Field of the Invention

The present invention relates to a domestic cooking appliance with a controllable exhaust venting system that enhances cooking and cleaning functions.

2. Prior Art

Odours, carbon monoxide and smoke are typical undesirable by-products of all ovens and particularly during the self clean cycle of self clean ovens. Experimental results indicate there is a linear relationship between the three with smoke and odour, more open to individual interpretation Carbon monoxide has a definite and tangible measure, for which performance can be gauged.

The use of pyrolytic oxidation units is well known during self cleaning mode of self-clean ovens. During cooking and in particular broiling, smoke and other by products are also produced. It would be desirable to provide a venting system that improves the pyrolytic oxidation and removes smoke and other by products during cooking by reducing the output of carbon monoxide.

SUMMARY OF THE INVENTION

It is an object of the present invention to provide a cooking appliance and method for reducing smoke or other by products from a cooking appliance that goes some way to overcoming the abovementioned disadvantages in the prior art or which will at least provide the public with a useful choice Accordingly, the present invention consists in a cooking appliance comprising:

a cabinet;

at least one oven within said cabinet wherein an air space is provided between said cabinet and said at least one oven;

means to allow ambient air to enter and exit said air space;

an exhaust passage connecting said at least one oven with said air space; and cleaning means within said exhaust passage to clean air flowing from said at least one oven to said air space.

DETAILED DESCRIPTION OF THE PREFERED EMBODIMENTS

Figure 1:
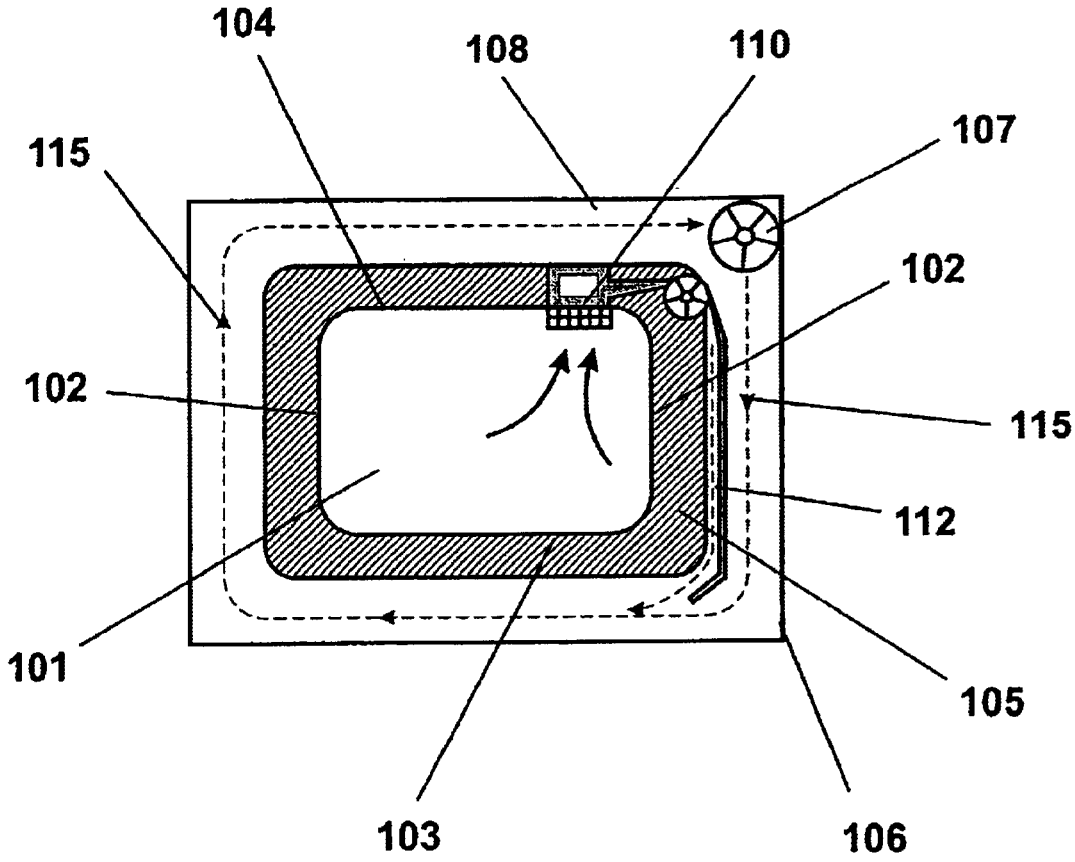
FIG. 1 is a partial cross-section of a single oven of the present invention.
Figure 3:
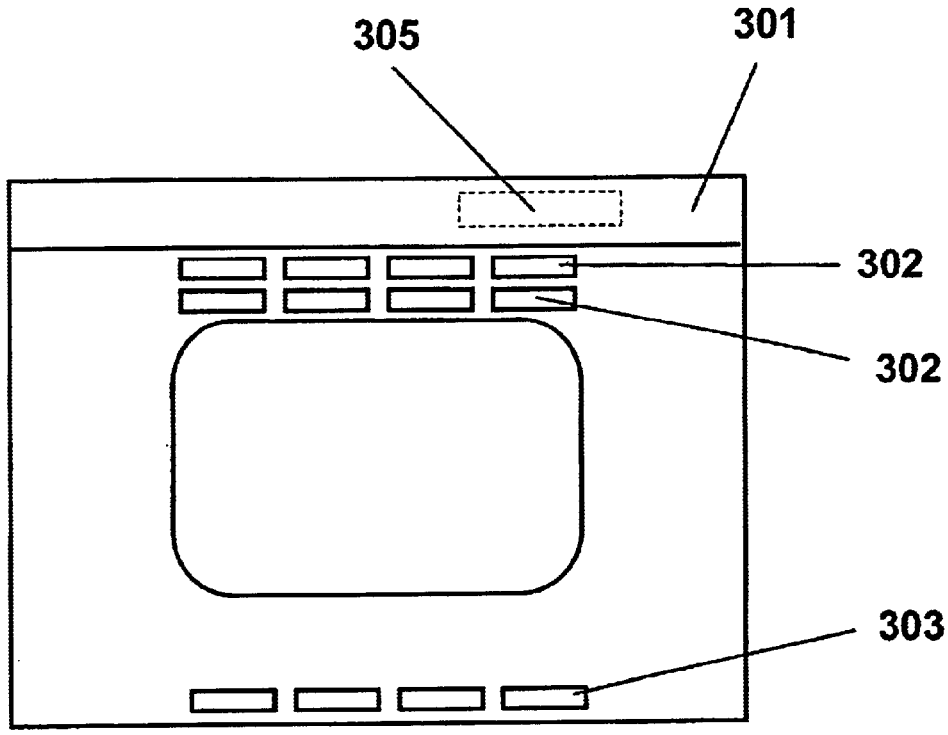
FIG. 3 is a front view of the single oven of the present invention.
Figure 4:
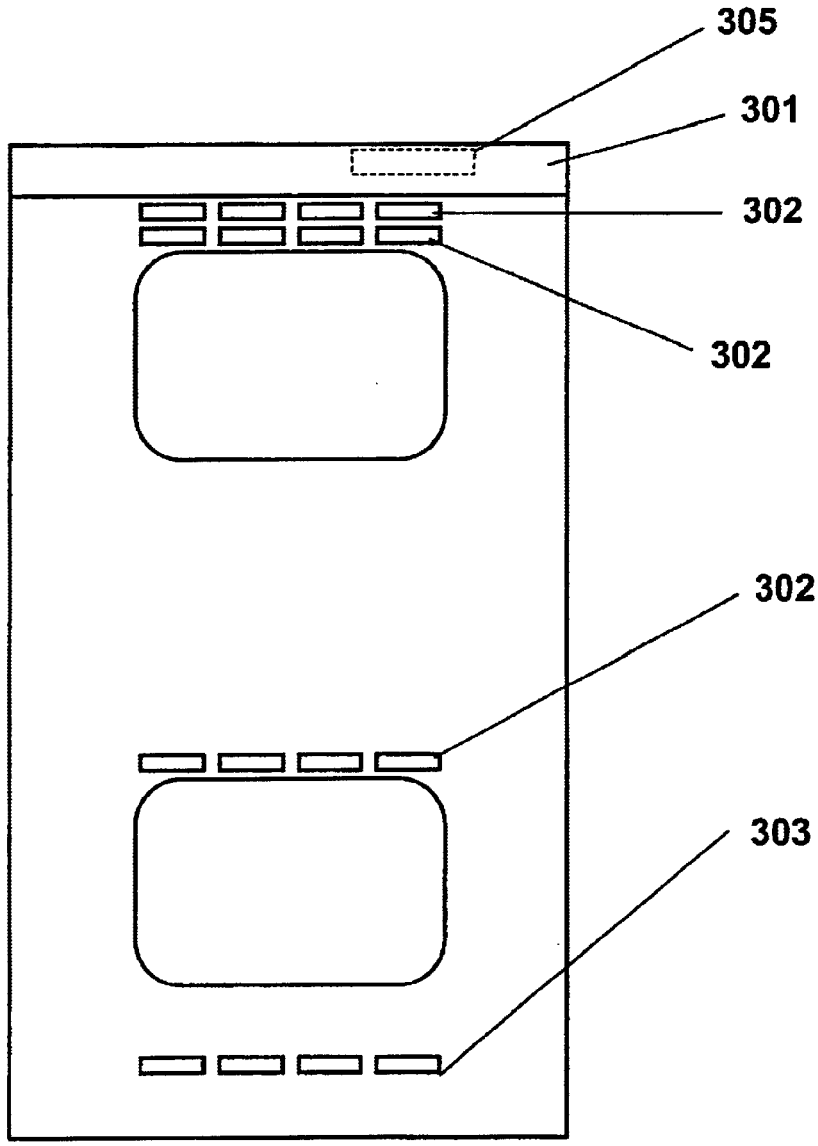
FIG. 4 is a front view of the double oven of the present invention.

The structure of the domestic oven of the present invention is for the most part conventional. Referring to FIGS. 3 and 4 the oven has a control panel 301 connected to a microprocessor 305 that controls the various functions of the oven. Referring to FIG. 1 the preferred embodiment of the present invention is shown, with a single oven cavity. The oven cavity 101 is formed by a liner having horizontal top 104 and bottom 103 walls and vertical side 102 and back walls. The front opening of the cavity 01 is sealed by a door (not shown) hingedly mounted or in an alternative embodiment slidably mounted to provide access to the cavity.

Door locking means (not shown) are provided to enable the door to be locked in the closed position. The oven includes a conventional lower bake heater unit (not shown) and an upper broiler or grilling heater unit (not shown). In the preferred embodiment two upper broil heater units are used. The terms broil and grill are used throughout this specification interchangeably. Thermal insulation 105 surrounds the cooking cavity 101 to retain oven heat within the cooking cavity 101.

Figure 2:
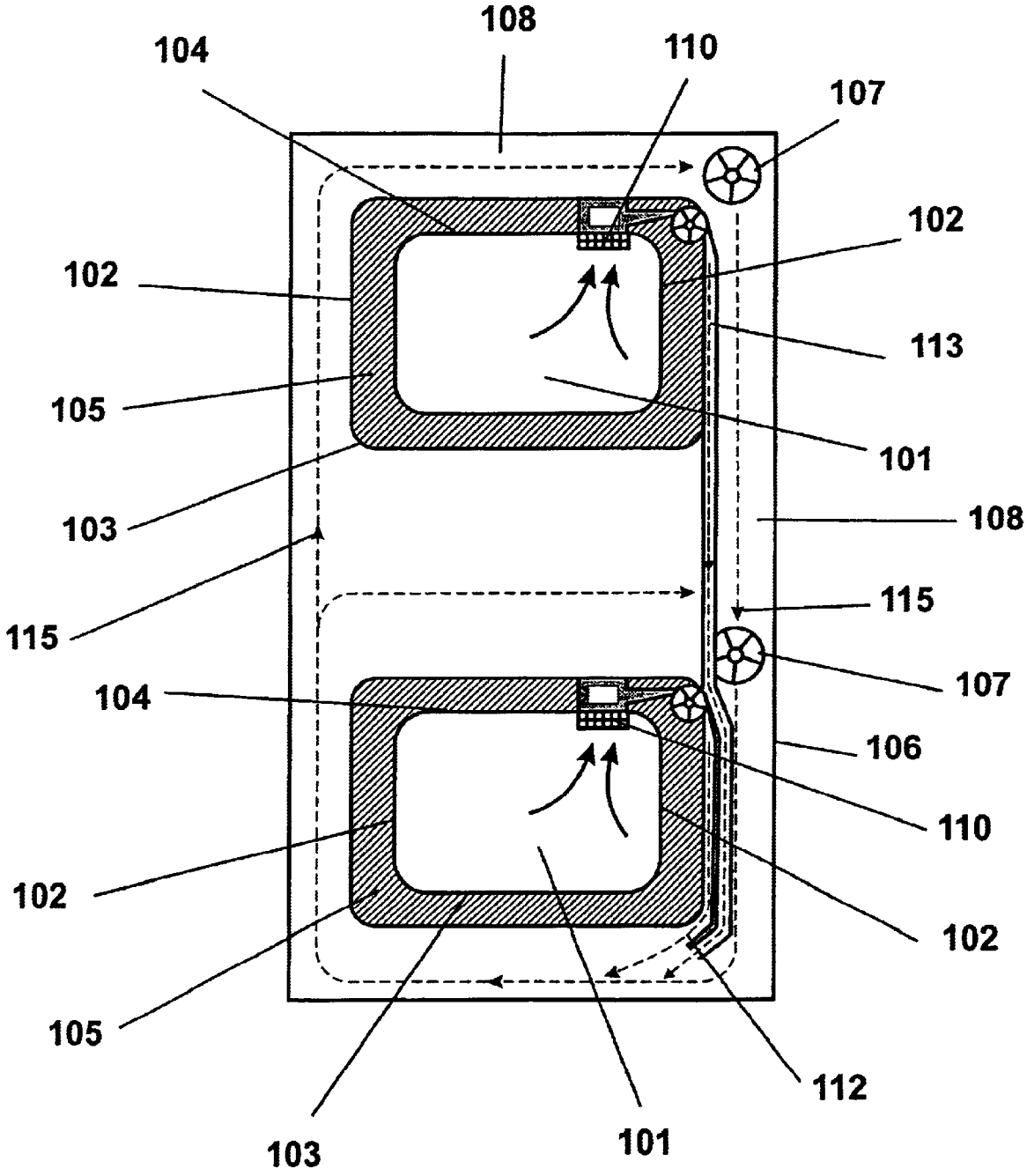
FIG. 2 is a partial cross-section of the double oven of the present invention.

FIG. 2 shows a double cavity oven of the preferred embodiment of the present invention, in FIG. 2 both cavities 101 are essentially the same size but the cavities could be of different sizes or side by side.

The oven cavity 101 and insulation 105 are surrounded by an outer wrapper or cabinet 106 which in the case of the double oven envelopes both cooking cavities. A cooling fan for the single cavity oven and cooling fans for the double cavity oven 107 circulates air in the cooling space 108 between the oven cavity 01 and the outer wrapper or cabinet 106.

Referring to FIGS. 3 and 4 inlets 302 and an outlets 303 at the front of the wrapper or cabinet allow air to enter and exit the cooling space 108. The fan or fans 107 circulate air within the cooling space 108 in the direction shown by the arrows 115 and the air is expelled through outlets 303.

In the preferred embodiment each oven cavity 101 has a convection fan (not shown) as is well known in the art but such a fan is not necessary to implement the invention.

Figure 6:
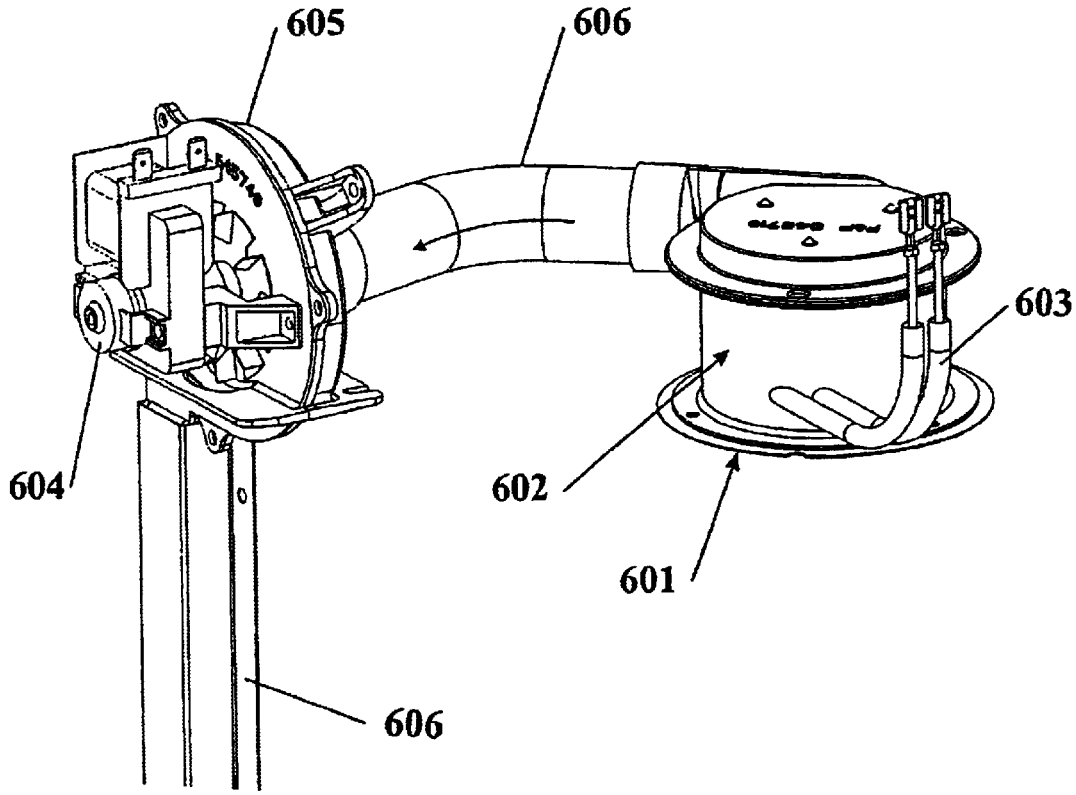
FIG. 6 shows the venting system of the present invention.

Each oven cavity 101 is provided with an exhaust vent 110 located in the horizontal top wall 104 of the cavity 101. In an alternative embodiment the vent 110 is located in the back wall of the cavity 101. The vent 110 could however be located in any wall of the cavity. The vent 110 connects the oven cavity 101 and the cooling space 108. The exhaust vent 110 is shown in more detail in FIG. 6. A stainless steel filter 601 is mounted at the junction of the vent 110 and the cavity 101. The use of a stainless steel filter 601 prevents cooking fats building up within the vent 110 and helps to contain residue within the oven cavity 101. A number of perforated holes of approximately 3 mm diameter through the filter allows for flow through the filter 601. To improve surface contact stainless steel mesh is welded to each side of the stainless steel filter 601. The use of the mesh aids in containing fats within the oven cavity 101 and out of the vent 110.

Interposed in the exhaust vent 110 is platinum charged catalytic oxidation chamber 602 as is known in the art and readily available from any number of vendors. The catalytic oxidation chamber provides a means for reducing carbon monoxide, smoke and odours. A heating element 603 is interposed within the vent 110 between the stainless steel filter 601 and the catalytic oxidation chamber 602. The heater 603 in the preferred embodiment a heating element, heats both the stainless steel filter 601 and the catalytic oxidation chamber 602.

A motor 604 and fan 605 are housed within the vent 10 to draw air through the stainless steel filter 601 and the catalytic oxidation chamber 602. The motor 604 and fan 605 are specified for elevated temperatures and are positioned downstream from the heating element and catalytic oxidation chamber 602 to ensure reliable operation. Air is drawn through the stainless steel filter 601, the catalytic oxidation chamber 602 and vent 606 by the fan 605 and expelled by the fan 605 into the cooling space 108 via vent 606.

High levels of chromium within the stainless steel filter 601 aid in the oxidation reaction with the platinum oxidation catalyst chamber 602. This reaction is aided further by the inclusion of a stainless steel filter disc of grade 304. This grade was selected for its high chromium (18–20%) which is an oxidising agent, low molybdenum (0% Mo) which is a corrosion inhibitor, average nickel content (8–10.50%) and its ability to sustain self-clean temperatures. Other stainless steel grades of a ferrite nature (e.g. 430SS 16–18% Cr.) may exhibit similar properties, but with reduced life expectancy.

The exhaust fumes generated by cooking and cleaning functions of the oven pass through the stainless steel filter 601 and contact the heating element 603. The heated fumes subsequently react with the platinum charged catalyst 602 and are drawn away from the reaction chamber by the extraction fan 605.

The processed cooking and/or cleaning fumes are expelled by the extraction fan 605 into the air space 108 via exhaust vent 606 shown in FIGS. 1 and 2 as 112 and 113. The processed cooking and/or cleaning fumes are mixed and diluted by the air circulating 115 in the cooling space 108 and the diluted processed fumes are subsequently expelled from the cabinet 106 via vents 303.

In the double oven design separate exhaust vents 112 and 113 reduce the possibly of exhaust gases from one cavity contaminating the other cavity. FIG. 2 depicts a double cavity oven configuration where exhaust vents 112 and 113 do not mix.

The exhaust fan 605 can provide a constant or variable flow within the reaction chamber 602 to maintain catalyst performance throughout the duration of the selected cooking mode. In an alternative embodiment the fan speed at different stages of the selected cooking mode could be altered.

In an alternative embodiment the system includes the ability to independently control each heating element and extraction fan within a double oven design. The use of the venting system within user modes of the oven is described below.

Self-Clean

To self clean the oven the user selects self clean mode from the control panel 301 and sets the temperature on the control panel 301 to maximum. The oven controller 305 is programmed to detect the changed control panel 301 setting and to implement the mode that the user has selected.

To implement self clean mode the oven controller 305 checks the oven door is closed by checking that the oven door closed sensor is active. If the door is closed, then the controller 305 activates the door lock preventing users inadvertently opening the door during the self clean cycle. Once the door lock is activated the oven controller 305 starts the cooling fan or fun 107 turns on the heating elements in the preferred embodiment the broil, bake and throat elements, turns on the vent fan 605 and the catalytic oxidation chamber 602 heating element 603.

The stainless steel filter 601 and oxidation chamber 602 are heated to operating temperatures by the dedicated heating element 603 and secondly, by the broil element that is positioned in close proximity to the catalyst inlet flow path.

The oven controller 305 maintains the temp at about 475° C./887° F. for a period of time sufficient to self clean the oven. At the expiry of that period, the controller 305 turns off the heating elements but the cooling fan 107, vent fan 605 and catalytic oxidation chamber heating element 603 remain on. The oven controller 305 monitors the oven temperature and after a cooling period and when the temperature has dropped to an acceptable level the oven controller 305 opens the door lock, and turns off the catalyst heating element. The oven controller 305 then commences the oven cooling process described below.

Broiling Function

In the preferred embodiment two broil elements are used to provide varying levels of cooking coverage. When a user activates broil mode the inner broil element only is used if the user activates maximum broil then the inner and outer broil elements are used. The user can select the desired cooking intensity by selecting the percentage of power for broil or maximum broil, for convection broil the user selects the cavity temperature. The system controller 305 receives the user selected options, from the control panel 301 and activates cooling fans 107. The controller 305 then activates the appropriate broil elements and activates the catalyst heating element 603. The controller 305 controls the broil elements so as to maintain the set temperature. If convection broil is selected the controller 305 activates the convection fan.

Once the set temperature is reached the controller 305 activates the vent fan 605 for a desired duration. In the preferred embodiment this is set to 20 minutes from start of activation. The controller 305 monitors user selection and if the user alters the mode selector then the controller 305 exits the broil mode. If the user has turned all user modes off the controller 305 activates the cooling mode as is described below.

Cooking foods removes moisture from the food to be cooked. Venting of the cooking cavity aids the removal of moisture from the cooking cavity and provides a means of moisture extraction during different stages and cooking modes.

Most foods are completely broiled within 20 minutes. Broiling tends to produce varying levels of noticeable cooking fumes and odours. Venting throughout the broiling cycle helps extract fumes from the cooking cavity 101. The heated catalyst 602 eliminates cooking odours and smoke prior to the exhaust fumes being expelled into the kitchen environment.

Using venting there is a significant reduction of visible smoke within the cooking cavity 101. Venting aids broiling by extracting a controlled flow of air from the cooking cavity 101. This enables the broil elements to remain effective for a longer period and maximizes radiant heat transfer. Venting, in effect, simulates the open door broiling technique, without subjecting users to potentially unsafe door temperatures. Venting allows the door to be closed during broiling.

Baking/Convection Functions

The user activates baking/convection cooking function by selecting the function from control Panel 301. The desired cooking temperature is then selected from a temperature scale on the control panel 301. The controller 305 receives the user selected option, and activates the cooling fans 107. If the controller 305 senses the door is closed, we controller 305 activates the appropriate heating element(s). If convection function is selected, the controller 305 activates the convection fan and heats, the cavity 101 until the set temperature is reached At the set temperature, the controller 305, activates the vent fan 605 for the desired duration, currently set at 20 min from end of preheat, and maintains the set temperature. If the controller 305 senses that the mode selector has been altered by the user then the controller 305 resets the oven elements and fans to the used selected cooling mode.

Venting improves cooking performance by removing moisture. This is particularly so far items baked for a short time, such as cookies requiring less than 20 minutes Tests show more uniform browning and quicker cook times. Less noticeable improvements are observed for foods requiring longer cooking such as roasts and vegetables taking upwards of an hour to cook.

To minimise potential condensation issues that may arise from excessive extraction of moist cooking fumes, venting for an initial 12 to 20 minutes has proven to provide the most ideal solution This minimises the risk of corrosion and other deposit issues within the vent 110 and cooling cavity 108.

Cooling Phase

A subset of all cooking functions is the cool down phase. The cool down phase is activated when a user deactivates the oven using the control panel 301 following cooking or cooling is automatically activated of the end of cleaning. The controller 305 initiates the cooling phase without user intervention and continues to operate the cool down phase until the oven cavity 101 reaches an acceptable level. The cool down phase minimizes the temperature rise experienced immediately following termination of cooking or cleaning. This is important for maintaining low temperatures for the controller 305 and control panel 301, as well as maintaining safe surface door and control panel 301 temperatures for consumer use.

Cool down in the prior art is limited to the cooling fans 107. The present invention introduces vent fan 605 operation into the cool down phase. This significantly reduced the cooling fan run on period, that is the duration users detect cooling fan noise without oven operation.

Double Oven

Figure 5:
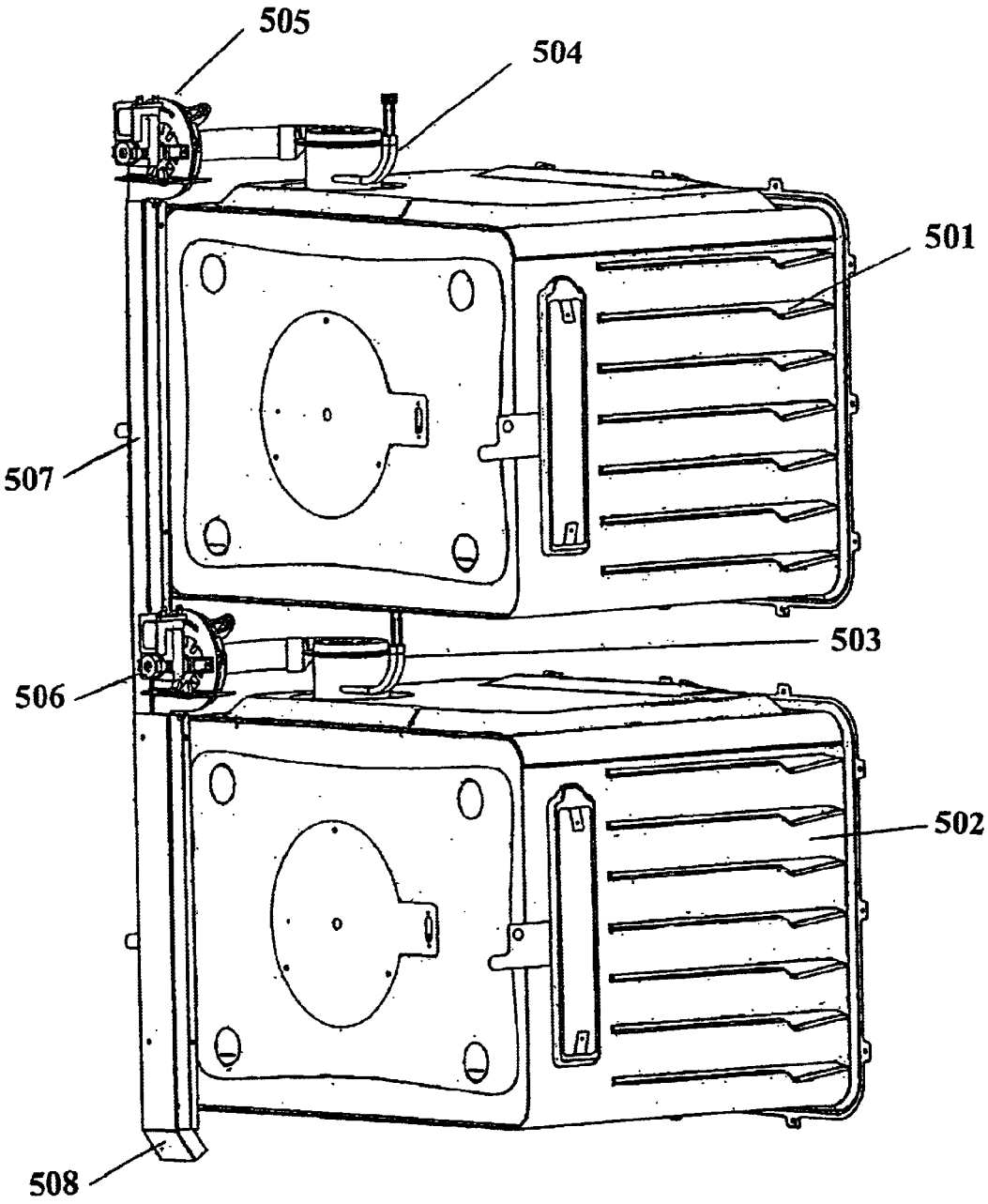
FIG. 5 shows the double oven of the present invention without the external wrapper.

Each cooking cavity 101, in a double oven is independent. Referring to FIG. 5 the upper cavity 501 and lower cavity 502 are shown. Each cavity has a separate venting system 503 and 504 including separate fans 505 and 506. The vent 507 from the upper cavity 501 remains separate from the lower cavity 502 vent 508. The present invention reduces the chance of cooking contamination between each cavity of the double oven. This is important where differing foods are cooked in each cavity simultaneously, or in situations where one cavity is utilized to store or warm foods of one type, during cooking in the other. The venting fans help prevent back flow of exhaust and contamination between cavities. The use of separate vents also helps prevent contamination between cavities.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

What is claimed is:

1. A cooking appliance comprising:

a cabinet;

at least one oven within said cabinet wherein an air space is provided between said cabinet and said at least one oven;

means to allow ambient air to enter and exit said air space;

an exhaust passage connecting said at least one oven with said air space;

cleaning means within said exhaust passage to clean air flowing from said at least one oven to said air space;

an exhaust fan located downstream of said cleaning means within said exhaust passage to displace air from within said at least one oven and expel air into said air space;

a controller for controlling the operation of said appliance wherein said controller activates said exhaust fan to draw air from within said oven for a pre-determined period of time.

2. A cooking appliance as claimed in claim 1 wherein said cleaning means comprises:

a catalytic oxidisation unit within said exhaust passage;

a filter located proximal to and upstream of said catalytic oxidisation unit, to prevent fats and solids from entering said catalytic oxidisation unit;

a heater for heating said oxidisation unit and said filter.

3. A domestic cooking appliance as claimed in claim 2 wherein said heater is located between said oxidisation unit and said filter.

4. A domestic cooking appliance as claimed in claim 3 including a controller for controlling the operation of said appliance wherein said controller activates said heater for a pre-determined period of time.

5. A domestic cooking appliance as claimed in claim 4 having operational modes including broiling, cooking, and cooling wherein said predetermined period of tune depends on said operational mode.

6. A domestic cooking appliance as claimed in claim 2 including a controller for controlling the operation of said appliance wherein said controller activates said heater for a predetermined period of time.

7. A domestic cooking appliance as claimed in claim 6 having operational modes including broiling, cooking, and cooling wherein said predetermined period of time depends on said operational mode.

8. A domestic cooking appliance as claimed in claim 1 having operational modes including broiling, cooking, and cooling wherein said predetermined period of time depends on said operational mode.

* * * * *

UNITED STATES PATENT AND TRADEMARK OFFICE

CERTIFICATE OF CORRECTION

PATENT NO. : 6,913,012 B2
DATED : July 5, 2005
INVENTOR(S) : Timothy Andrew Divett et al.

It is certified that error appears in the above-identified patent and that said Letters Patent is hereby corrected as shown below:

Column 2,
Lines 5 and 26, “cavity 01” should be -- cavity 101 --.
Line 64, “vent 10” should be -- vent 110 --.

Column 3,
Lines 65-66, “475º C./887º F.” should be -- 475º C/887º F --.

Column 6,
Line 38, “of tune” should be -- of time --.

Signed and Sealed this

Thirtieth Day of August, 2005

JON W. DUDAS
*Director of the United States Patent and Trademark Office*